US008778042B2

(12) United States Patent
Albert

(10) Patent No.: US 8,778,042 B2
(45) Date of Patent: Jul. 15, 2014

(54) FLAT DUCT VENT FILTER COVER

(71) Applicant: James Albert, Naples, FL (US)

(72) Inventor: James Albert, Naples, FL (US)

(73) Assignee: James Albert, Naples, FL (US)

( * ) Notice: Subject to any disclaimer, the term of this patent is extended or adjusted under 35 U.S.C. 154(b) by 0 days.

(21) Appl. No.: 13/836,245

(22) Filed: Mar. 15, 2013

(65) Prior Publication Data

US 2013/0212991 A1 Aug. 22, 2013

Related U.S. Application Data

(63) Continuation-in-part of application No. 13/398,137, filed on Feb. 16, 2012.

(51) Int. Cl.

| | |
|---|---|
| ***B01D 59/00*** | (2006.01) |
| ***F24F 13/20*** | (2006.01) |
| ***F24F 13/28*** | (2006.01) |
| ***F24F 13/06*** | (2006.01) |
| *A47L 9/14* | (2006.01) |

(52) U.S. Cl.

CPC ..... *F24F 13/28* (2013.01); *A47L 9/1427* (2013.01); *F24F 13/20* (2013.01); *F24F 13/06* (2013.01)

USPC ..... 55/373; 55/378; 55/380; 55/385.2; 55/429; 55/478; 96/136; 96/139; 96/224; 96/415; 96/421

(58) Field of Classification Search

CPC ..... A68B 19/00; B01D 46/02; B01D 46/05; B01D 46/10; B01D 46/23–46/24; B01D 46/2411; A47L 5/362; A47L 5/365; A47L 9/1427

USPC ..... 55/373, 380, 385.2, DIG. 35, 478, 429, 55/481, 495, 506; 484/289, 370; 96/136, 96/139, 224, 415, 521

See application file for complete search history.

(56) References Cited

U.S. PATENT DOCUMENTS

| | | | | |
|---|---|---|---|---|
| 5,597,392 | A * | 1/1997 | Hawkins et al. | 96/222 |
| 6,171,354 | B1 | 1/2001 | Johnson | |
| 6,257,976 | B1 * | 7/2001 | Richardson, III | 454/309 |
| 6,461,235 | B2 * | 10/2002 | Rutler et al. | 454/289 |
| 2008/0160903 | A1 * | 7/2008 | Fontana | 454/289 |

* cited by examiner

*Primary Examiner* — Robert Clemente
*Assistant Examiner* — Karla Hawkins
(74) *Attorney, Agent, or Firm* — Hahn Loeser & Parks LLP; Shannon V. McCue

(57) ABSTRACT

An exterior duct filter retainer used in connection with a heating and air conditioning vent, the duct filter retainer including a filter body constructed of a material that is air permeable yet catches particles exiting the vent, the filter body having a an attachment assembly connected to the filter body; the attachment assembly being adapted to attach the filter body such that the filter is against and/or in registry with the vent. The filter body can be flat, and the attachment assembly can use a variety of means to attach the filter body in registry with the vent.

20 Claims, 8 Drawing Sheets

FLAT DUCT VENT FILTER COVER

CROSS-REFERENCE TO RELATED APPLICATIONS AND INCORPORATION BY REFERENCE

This application is a Continuation in Part of U.S. patent application Ser. No. 13/398,137, entitled "DUCT VENT FILTER COVER", filed on Feb. 16, 2012, which is incorporated herein by reference in its entirety.

TECHNICAL FIELD

In general, the invention relates to the field of building construction supplies, and more particularly to a temporary duct filter bag or retainer that encompasses the exterior of a vent to catch debris and other particulates expelled from the vent during construction.

BACKGROUND OF THE INVENTION

Today most indoor spaces in homes and offices are cooled by central air conditioning systems that pull air from each room, through ducts, and to an HVAC handler unit. In the HVAC handler unit, the air is cooled by passing it over coils that are filled with a refrigerant. After cooling, the air is forced through supply ducts leading to supply vents within each room of the interior space. The cool air exits the supply vents and fills the interior living space in order to maintain a desired temperature level. When the air is pulled from the indoor living spaces and through the return ducts, the air is directed through one or more filters that trap some, dirt and germs before the returning air reaches the HVAC handler unit. The primary purpose of these filters is not to keep the air clean in the indoor living environment. Instead, these filters are meant to remove dust and dirt before the air reaches the evaporator coil and blower of the HVAC handler units so that the coils stay clean for efficient heat transfer. Over time, the ducts and/or equipment need to be replaced because of decay, deterioration, mold, asbestos, equipment failure or re-sizing.

Accordingly, when the old ducts or equipment are removed and the new ducts or equipment installed, or during various other operations (e.g., cleaning ducts, initial air forced through ducts after period of inactivity, air forced through ducts during/after construction or fumigation, and others) there remains a need for a filter that is specifically adapted for placement on the outside and over the air supply vents of an air conditioning system in order to remove dirt, soot, fiberglass, mold, asbestos, debris, and other particles or contaminants from falling out or from the cool airflow forcing it to enter the indoor living environment. For simplicity, the various particles and contaminants will be collectively referred to as particles below.

SUMMARY OF THE INVENTION

The present invention generally includes a duct filter bag or retainer that temporarily covers a supply air duct or vent that provides air to an indoor space. The duct filter bag or retainer includes a filter body and an attachment assembly, where the filter body defines a filter volume about the vent into which particles expelled from the vent are captured before entering the conditioned space.

The present invention further includes a duct filter bag or retainer used in connection with a heating and air conditioning vent, the duct filter bag or retainer including a filter body constructed of a material that is air permeable yet catches particles exiting the vent, the filter body having a perimeter; an attachment assembly connected to the filter body; where the filter body is extendable outward relative to the attachment assembly to define a filter volume; the attachment assembly being adapted to attach the filter body such that the filter volume is in registry with the vent The present invention also provides a method of providing a temporary filter for an HVAC vent, a method including providing a filter body constructed of a material that is breathable yet capable of catching particles existing the vent; applying an attachment assembly to a perimeter of the filter body; and fastening the attachment assembly to place the filter body in registry with the vent.

BRIEF DESCRIPTION OF THE DRAWINGS

For a further understanding of the nature of the present invention, reference should be made to the following detailed description in conjunction with the accompanying drawings.

DETAILED DESCRIPTION OF THE INVENTION

Figure 1:
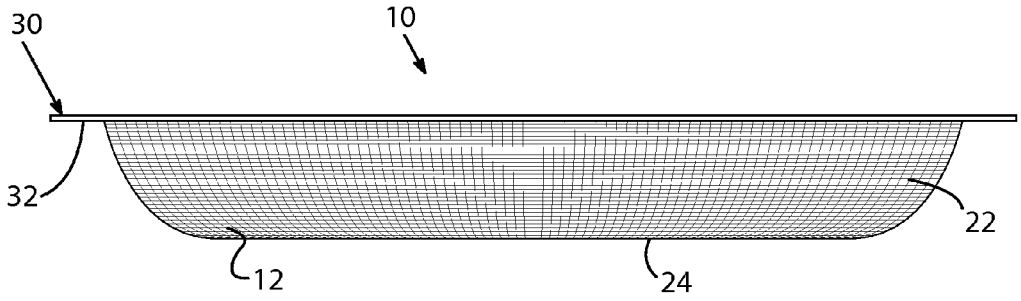
FIG. 1 is a side elevational view of a duct filter bag according to the concepts of the present invention.

As discussed earlier, as used herein, the term "particles" can include (but is not limited to) dirt, dust, soot, pollen, spores, glass, fiberglass, mold, asbestos, debris, hair, dander, bugs or insects, sawdust, fumes, smoke, and other particles or contaminants that can be within ductwork.

As used herein, "filter material" can include various meshes, grates, porous surfaces, and other (at least semi-) air-permeable materials or structures including (but not limited to) textiles (e.g., technical fabrics, porous fabrics, synthetics), polymers, metals, fiberglass, rubbers, ceramics, foams, glass, and other medium. Filter material or media can be inelastic or elastic in various embodiments. Other details or examples of filter material can be provided elsewhere herein, and particular embodiments described are not intended to limit alternatives. While filter materials generally return to permeable materials, specific portions of a filter body herein can be made at least in part of impermeable materials, as will be indicated hereafter, without departing from the spirit or scope of the innovation.

A duct filter bag according to the concepts of the invention is generally indicated by the number 10 in the drawings. Duct filter bag 10 is temporarily placed over a vent V, which may be a ceiling mounted supply vent as shown, to catch particles or contaminants exiting the vent V. The types of particles or contaminants that may be exiting the vent V vary depending on the heating, ventilation, and cooling (HVAC) system being repaired or installed/repaired, environmental conditions, and on the nature of the space. For example, when replacing or repairing older systems, a buildup of dust, dander, hair, soot, asbestos, and mold may be found in the ductwork of the HVAC system and expelled from the vent V during repair. Larger particles including construction debris, paint chips, wood splinters or fiberglass may also be present. It is also contemplated that smaller particles or contaminants including chemical fumes may be expelled from the vent V. The above examples should not be considered limiting. For sake of simplicity, all particles and contaminants to be filtered by the duct filter bag 10 will collectively be referred to as particles. Depending on the type of particles to be filtered, the level of filtration may be altered as described more completely below.

Duct filter bag 10 includes a filter body 12, which may be constructed of any suitable material that allows at least some air flowing from a vent V to escape while catching particles exiting the vent V. The amount of air flow permitted may vary depending on the application and the types of particles to be filtered. In general, the smaller the particle to be filtered, the greater the restriction of the air flow. In some cases, maintaining air flow will be as important or more important than filtering smaller particles. For example, when filtering dust and construction debris, it has been found that adequate air flow for conditioning a space is maintained when using a filter fabric capable of 20-25 micron filtration and having a weight of 30-50 grams per square meter. This example is not, however, limiting as it is expected that other levels of filtration and fabric weights would also be suitable. For example, to filter fumes or mold, smaller micron material would be used. For example, a 0.3 micron High-Efficiency Particulate Air (HEPA) filter would be suitable. Alternatively, if relatively large debris is expected or greater airflow is needed a material having pores greater than 25 microns may be used.

In general, filter body 12 is air permeable and may be constructed of any material and have any configuration that catches particles yet allows air to pass through. The filter body 12 may include a screen or mesh formed of any suitable material, or, it may be formed of a breathable fabric (FIG. 4), that is air permeable or has pores allowing air to pass. The examples shown in FIGS. 1-5 and 5 schematically show filter body 12 as having a screen or mesh-like structure, but it will be understood that filter body 12 may have other configurations. For example filter fabrics (FIG. 4) often have amorphous openings or pores 17 that do not follow a regular pattern. To that end, the figures should not be considered limiting.

The proportions of the duct filter bag 10 may vary depending on the size of the vent V. In general, duct filter bag 10 is sized and configured to fit over the entire opening of vent V so that duct filter bag 10 confronts the airflow exiting the vent V. In the example shown, duct filter bag 10 has a rectangular configuration to allow it to conform to a rectangular vent V. Any other shape may be used, and thus, the shape shown in the drawings should not be considered limiting.

As shown, filter body 12 may be configured to define a filter volume 20 adjacent to vent V. As shown in the depicted example, the filter volume 20 may be formed by configuring filter body 12 to have a bag-like shape. This configuration may be achieved by providing filter body with one or more sidewalls 22 extending outward from vent V and a base or bottom wall 24 that extends inward from the sidewall 22. Bottom wall 24 may lie generally normal to the air flow exiting the vent V. In embodiments, the air flow exiting vent V may be oblique to bottom wall 24. The sidewall 22 and bottom wall 24 may be formed from a single sheet or layer of filter material that is folded to achieve the desired shape. Alternatively, the sidewall 22 and bottom wall 24 may be formed by over-sizing the filter body 12 relative to the vent V and attaching it to the perimeter of the vent V such that the air flow causes the oversized material to billow outward from the vent V to form the filter volume 20, as in the depicted example shown in FIGS. 1-3.

Filter volume 20 can project outward relative to vent V to collect particles exiting the vent V. The filter volume 20 may collect particles to the point that the filter volume 20 is filled or the pores 17 of the filter body 12 clogged. Once this point is reached, the duct filter bag 10 can be removed and the entire duct filter bag 10 or simply the collected particles within the duct filter bag 10 may be discarded.

An attachment assembly, generally indicated by the number 30, is provided to attach filter body 12 so that it is in registry with vent V. Such that air exiting vent V must pass through filter bag 10. Attachment assembly 30 may attach to the vent V or an area of the structure S surrounding the vent V. Attachment assembly may include a fastener including but not limited to Velcro, an adhesive or an elastic band, or adhesive tape to attach duct vent bag 10, as described more completely below. To avoid particles escaping from around filter body 12, attachment assembly may also act as a seal between the filter body 12 and the vent V or surrounding structure S. Alternatively, a separate seal may be provided to be used in connection with attachment assembly.

Figure 2:
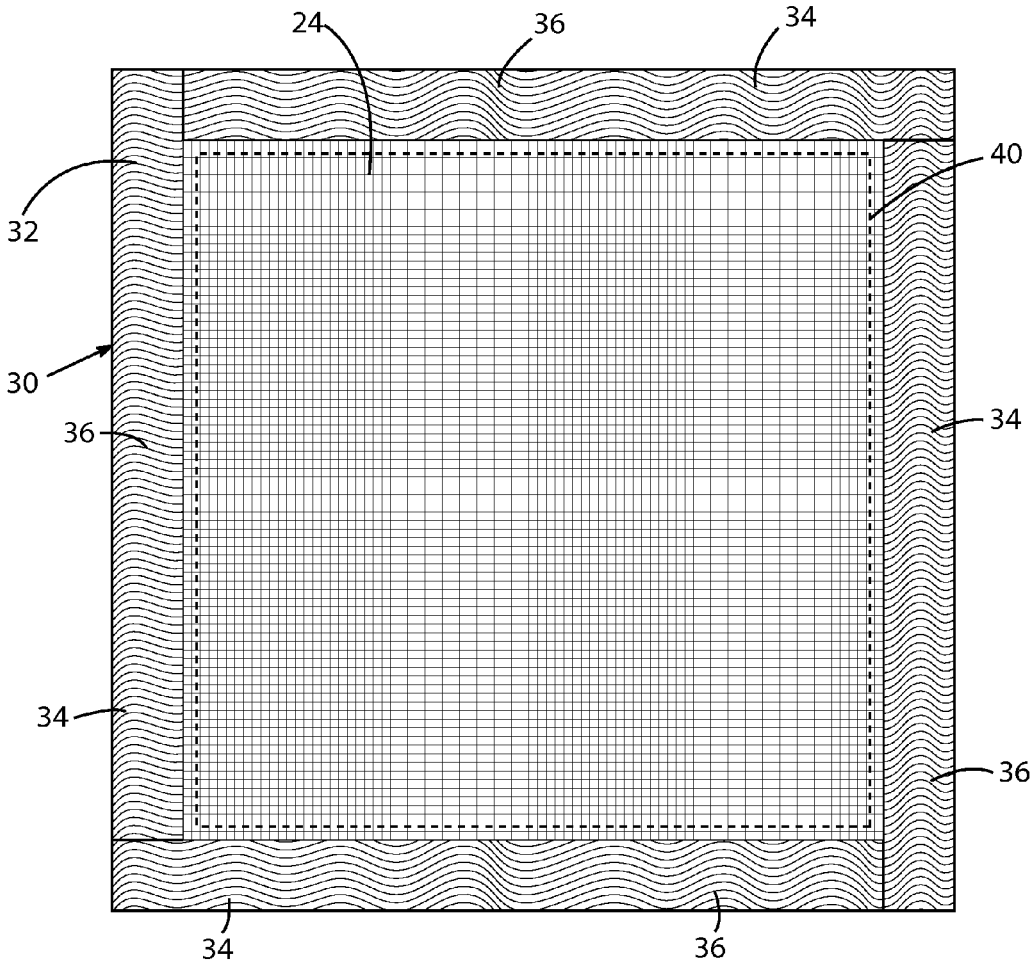
FIG. 2 is a top plan view thereof.

In the example shown in FIGS. 1 and 2, attachment assembly includes a frame 32. Frame 32 may be a solid frame that attaches to filter body 12, or, as shown, frame 32 may be constructed of a flexible material. In FIGS. 1 and 2, frame 32 is constructed of strips of tape 34 that have an adhesive on a single side 36. The tape 34 is, therefore, arranged so that a portion of the adhesive side 36 overlies a perimeter 40 of filter body 12 and extends outward of the perimeter 40 of filter body 12 to attach to vent V or a surrounding structure S. Alternatively, frame 32 may be constructed of double sided tape with a first adhesive side attached to the filter body 12 and a second adhesive side attached to the vent V or a surrounding structure S. In either example, to facilitate handling and packaging of the duct filter bags 10, a release layer may be provided to cover the exposed adhesive side 36. Before installing, the release layer would be removed by the user and the duct filter bag 10 attached by adhering the exposed portion of adhesive side 36 to the vent V or a surrounding structure S.

Figure 3A:
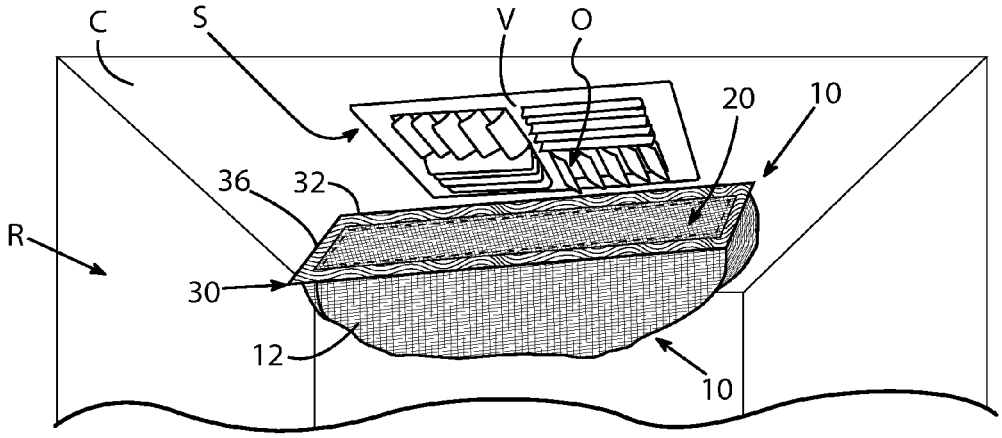
FIGS. 3A-3C are a series of perspective views showing installation of a duct filter bag according to the concepts of the present invention over a supply vent.
Figure 3B:
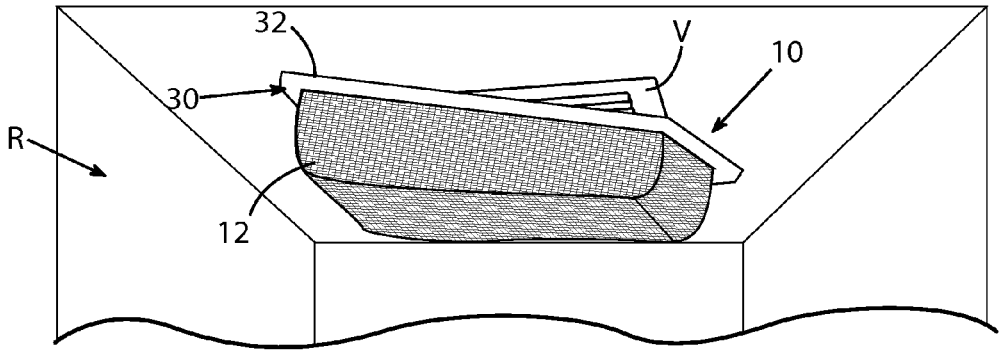
Figure 3C:
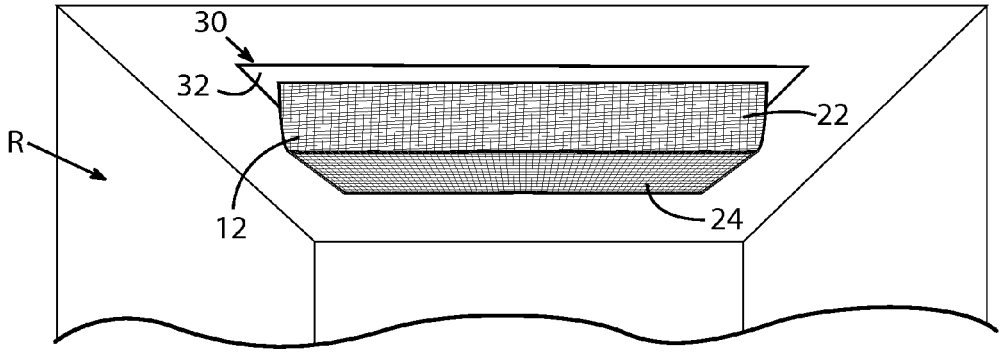

While aspects herein describe attachment to vent V or other portions, it is to be appreciated that a filter can be configured to attach to walls, ceilings, frames, et cetera, which are not the vent itself. Further, while illustrated aspects such as those in FIGS. 3A, 3B, and 3C show a filter body sized approximately in accordance with the size of vent V size, it is to be appreciated that any filter construction of a size that covers vent V (or specific openings O of vent V) can be utilized without departing from the spirit or scope of the innovation. In a non-limiting example, a filter (e.g., a flat filter as described herein) with dimensions 16 inches by 16 inches can be used to cover a vent that is 8 inches by 10 inches.

In embodiments, one or more additional seals (not pictured) can be employed in conjunction with duct vent bag 10. For example, frame 32 can have an appropriately shaped packing or toric joint (e.g., o-ring, gasket) that faces vent V, inset in frame 32 and wrapping completely around filter body 12, in order to ensure an airtight seal is achieved. The packing or toric joint can be made of any suitable material impermeable to air and particles. In alternative embodiments, multiple seals (e.g., along each length of single side 36 that coincide at corners or where single side 36 meets another) can be employed to create an airtight seal.

Figure 4:
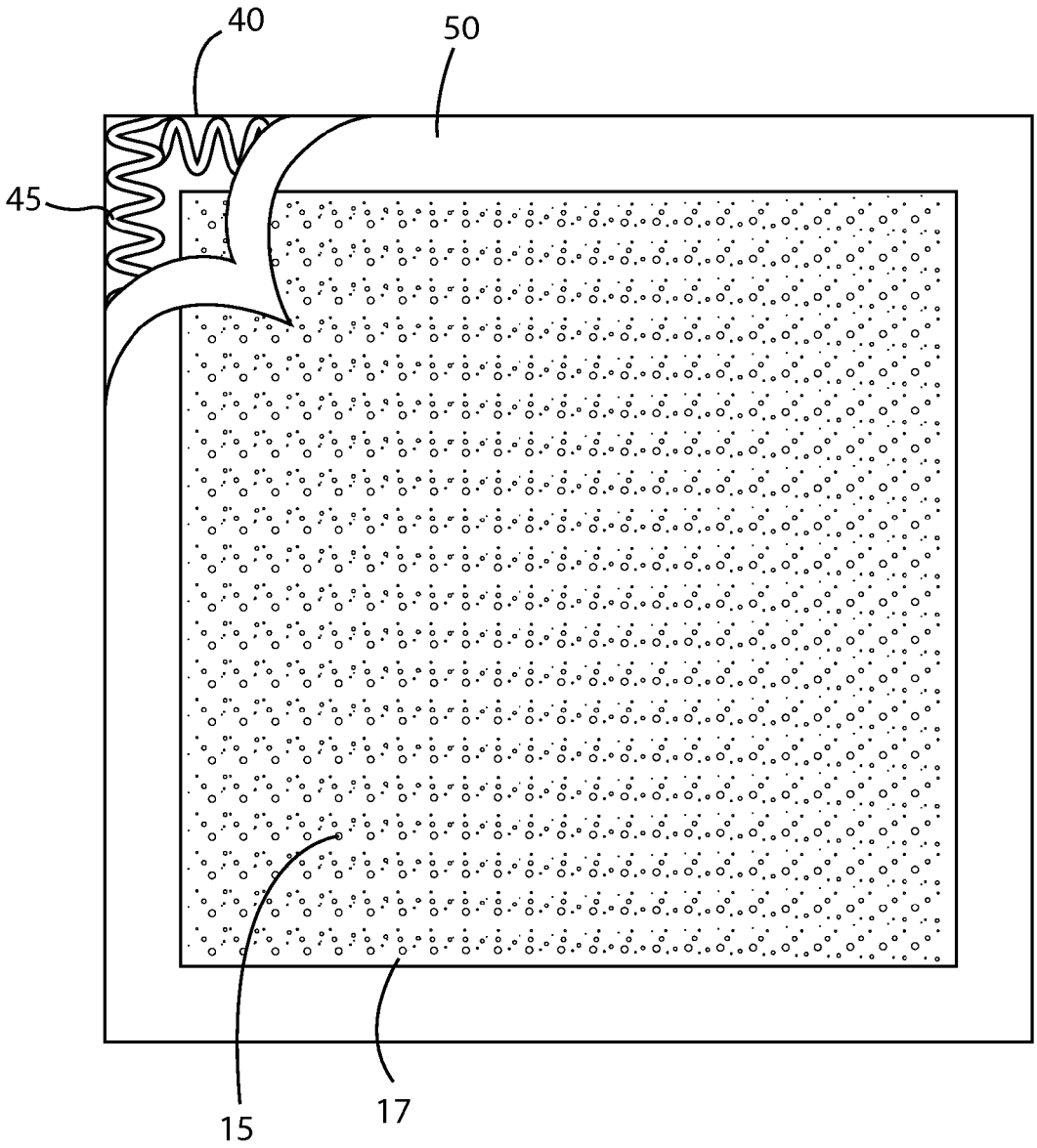
FIG. 4 is a top plan view similar to FIG. 2 of an alternative embodiment of a duct filter bag according to the concepts of the present invention.

FIG. 4 shows an alternative embodiment of the present invention. In particular, FIG. 4 schematically shows a duct filter bag 10 having a filter body 12 constructed of a porous fabric 15. It will be appreciated that the pores 17 schematically represented in FIG. 4 may have any shape and be of any size that permits air to pass through the filter body 12 while filtering particles based on the needs of the application. The pores 17 are enlarged for purposes of illustration only. Likewise, pores 17 need not have the circular shape shown and may have other shapes including randomly shapes pours formed through a fiber of the filter fabric.

As shown in FIG. 4, attachment assembly 30 may include an adhesive 45 applied directly to the filter body 12. In the example shown, adhesive 45 is applied at the perimeter 40 of filter body 12. Adhesive 45 may be any adhesive suitable for attaching filter body 12 about the vent V. Depending on the type of adhesive 45, a release layer 50 may be provided to cover adhesive 45 until the user is ready to install the duct filter bag 10. As shown, release layer 50 may be peeled away to expose adhesive 45, and the duct filter bag 10 installed as described with reference to FIGS. 3A-3C below. Alternatively, adhesive 45 may be a contact adhesive that requires pressure to bond the adhesive 45 to a structure. In this example, a release layer 50 may be omitted. To install the duct filter bag, the method shown in FIGS. 3A-3C below would be used with the additional step of applying sufficient pressure to form an adhesive bond between the margins of the duct filter bag 10 and the surface to which it is attached.

FIGS. 3A-3C show an example of a method of installing a duct filter bag 10 according to the invention about a vent V. In the example shown, the vent V is located in the ceiling C of a ventilated space or room R. It will be appreciated that vent V may be located at other locations within the structure, and the duct filter bag 10 applied in the manner described below without departing from the spirit or scope of the invention. As shown in FIG. 3A, the duct filter bag 10 is positioned to encompass the vent V and in particular any openings O within vent V. Attachment assembly 30 is used to attach duct filter bag 10 to vent V or, as shown, the surrounding structure S. In the example shown, attachment assembly includes a frame 32 constructed of tape 34. The frame of tape 34 may be applied prior to positioning the duct vent bag 10 relative to vent V, or filter body 12 may be positioned about vent V and the tape 34 applied to form frame 32 in place.

FIG. 3B shows a duct filter bag 10 with frame 32 already in place. The exposed adhesive side 36 of frame 32 is then pressed against structure S to attach duct filter bag 10 and concurrently seal perimeter 40 of duct filter bag 10 around vent V, as best seen in FIG. 3C.

Figure 5:
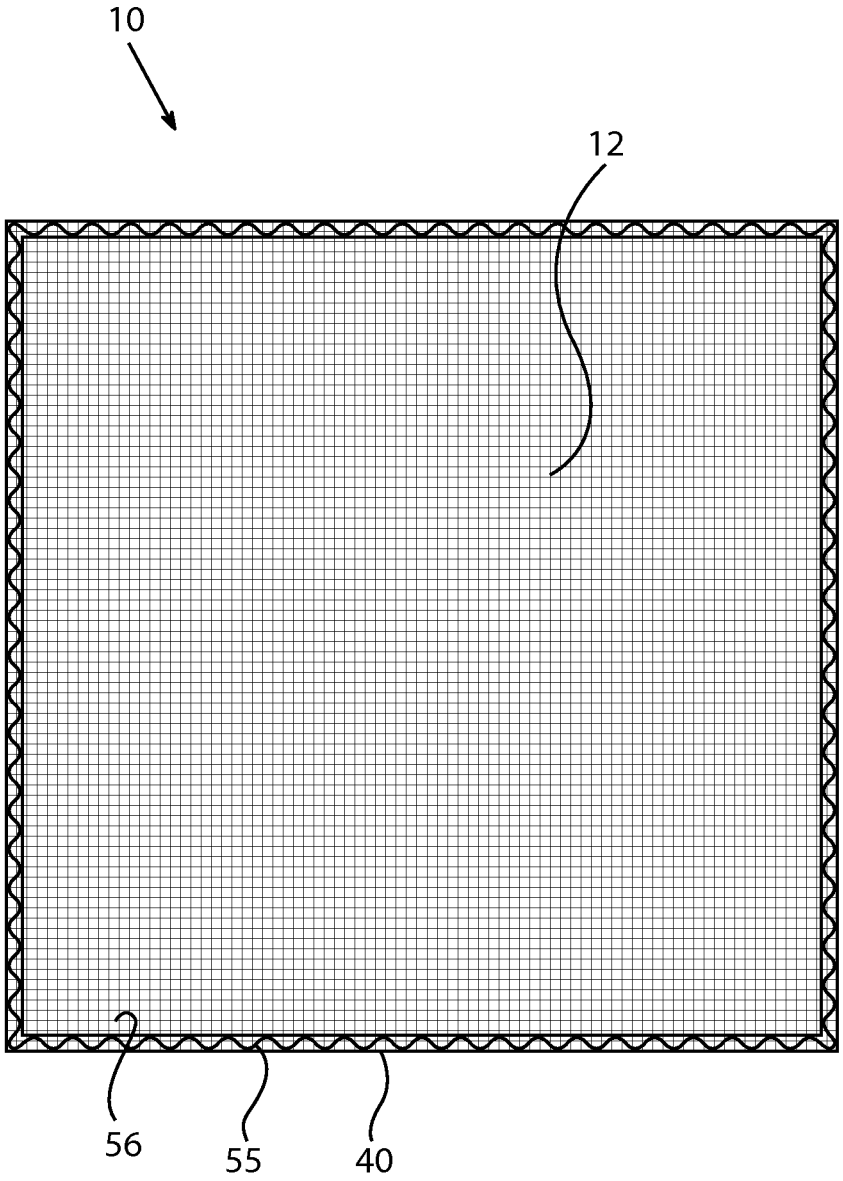
FIG. 5 is a top plan view similar to FIG. 2 of another alternative embodiment of a duct filter bag according to the concepts of the present invention.

As shown in FIG. 5, attachment assembly 30 may be an elastic member, such as a band 55. Elastic band 55 may be attached to the perimeter 40 of duct filter bag 10 in any known manner. In the example shown, elastic band 55 is bonded to the perimeter 40 of duct filter bag 10. The opening 56 defined by elastic band 55 is generally smaller than the vent V or other protruding portion of the duct to which the duct filter bag 10 is to be attached. In this way, the perimeter 40 of duct filter bag 10 is stretched against the force of the elastic band to fit duct filter bag 10 over vent V to grasp the vent V or a surrounding surfaces to hold duct filter bag 10 in registry with vent V. While the opening 56 formed by the perimeter 40 of duct filter bag 10 shown in FIG. 5 is generally rectangular in shape, any shape may be used, including other polygon shapes or irregular shapes defined by the elastic material forming the band 55.

Figure 6:
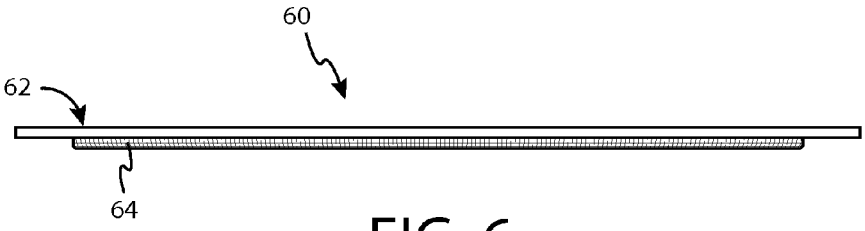
FIG. 6 is a side elevational view of a flat duct filter retainer according to the concepts of the present invention.

Turning now to FIG. 6, illustrated is a side elevational view of flat duct filter retainer 60 according to the concepts of the present invention. Flat duct filter retainer 60 can include attachment assembly 62 and flat filter body 64. Flat filter body 64 can be substantially flat, and in embodiments can be flush across aligned with attachment assembly 62. In embodiments, flat filter body 64 can be (e.g., at least slightly) oversized (e.g., larger surface area than the interior or opening of attachment assembly 62) to facilitate near-flush application to a vent while accommodating protrusions (e.g., vent slats, toggles to open or close vents) of the vent.

While FIG. 6 shows flat filter body 64 as protruding from attachment assembly 62, it is to be appreciated that such illustration is for purposes of understanding, and not required in all embodiments. In embodiments, flat filter body 64 can protrude from the side of attachment assembly 62 pictured in FIG. 6, and in alternative embodiments flat filter body 64 can protrude from the other side of attachment assembly 62. In still alternative embodiments, the view illustrated in FIG. 6 does not show flat filter body 64, as flat filter body 64 can coincide with attachment assembly 62 through common planes and not protrude to either side.

Figure 7:
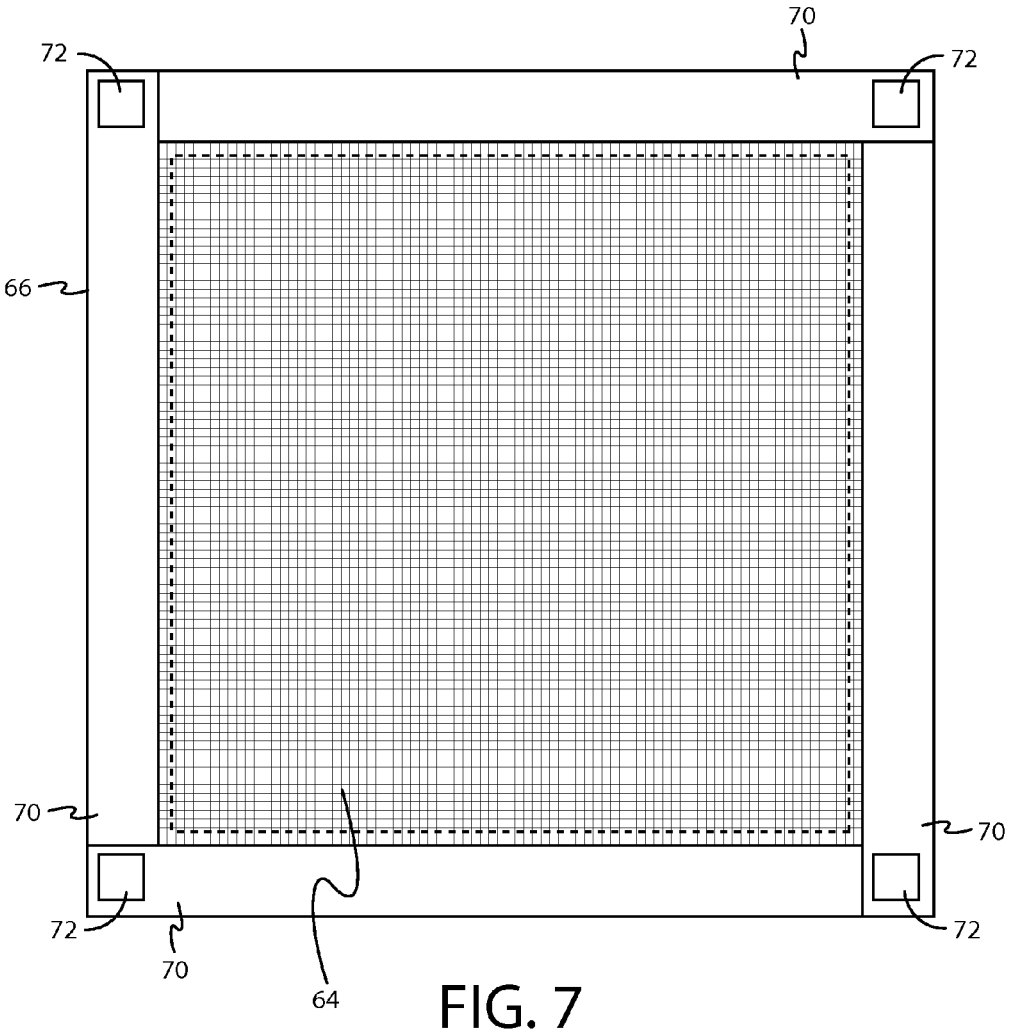
FIG. 7 is a top plan view thereof.

FIG. 7 illustrates a top plan view of flat duct filter retainer 60. Flat duct filter retainer 60 can include attachment assembly 62 and flat filter body 64. Flat filter body assembly can include frame 66, single side 70, and attachment 72. In embodiments (e.g., rectangular flat duct filter retainer 60), there can be four each of single side 70 and attachment 72.

As shown, attachment 72 can include various points of attachment, as distinguished from continuous attachment along the length of any respective single side 70. While attachment 72 is shown in a corner of flat duct filter retainer 60, those of ordinary skill in the art will appreciate other orientations. In embodiments, attachment 72 can be designed to interface with a portion of a vent (e.g., aligned with screws attaching a vent to a surface or duct, aligned with the corners of a vent, and others). In embodiments, attachment 72 can include hardware (e.g., nuts, bolts, clasps), magnets, adhesives, hook-and-loop surfaces, buttons, and/or other attaching means. In embodiments, multiple attachment means can be employed (e.g., two or more of the types listed on a single embodiment). In still further embodiments, a gasket, o-ring, tubing, or other seal can follow at least a portion of single side 70 to provide a seal against a vent where attachment 72 does not span the entire length of single side 70. In embodiments, attachment 72 can couple with hardware installed on, around, or to a vent. In embodiments, attachment 72 can be configured to be inserted into a vent to hold flat duct filter retainer 60 to the vent (e.g., expanding, compressible, inflatable, et cetera, portion that stays in place after placement through at least a portion of a vent).

In embodiments, one or more additional seals (not pictured) can be employed in conjunction with flat duct filter retainer 60. For example, frame 66 can have an appropriately shaped packing or toric joint (e.g., o-ring, gasket) that faces vent V, inset in frame 66 and wrapping completely around filter body 64, in order to ensure an airtight seal is achieved. The packing or toric joint can be made of any suitable material impermeable to air and particles. In alternative embodiments, multiple seals (e.g., along each length of single side 70 that coincide at corners or where single side 36 meets another) can be employed to create an airtight seal.

Figure 8A:
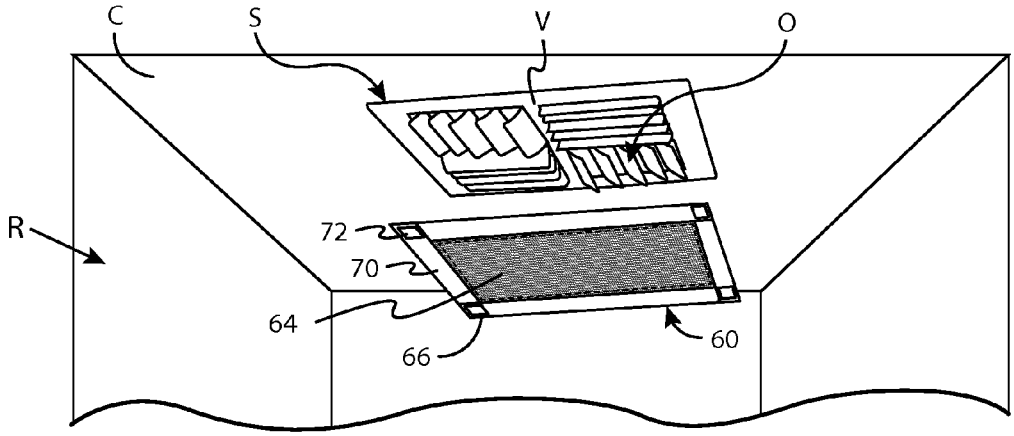
FIGS. 8A-8C are a series of perspective views showing installation of a flat duct filter retainer according to the concepts of the present invention over a supply vent.
Figure 8B:
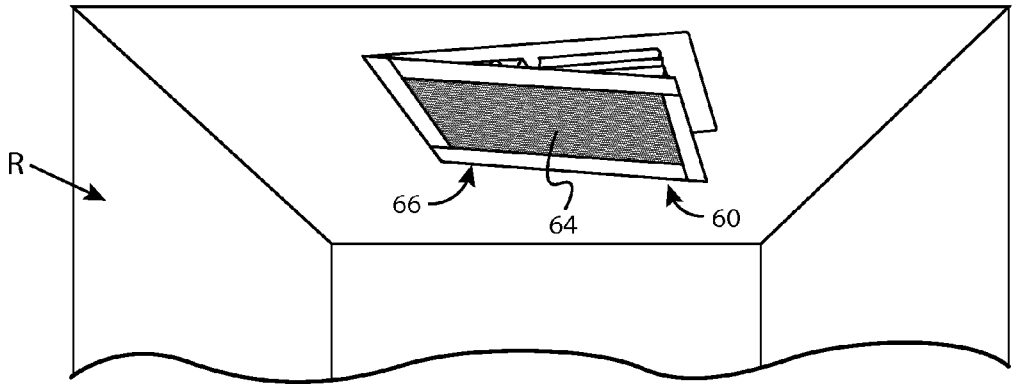
Figure 8C:
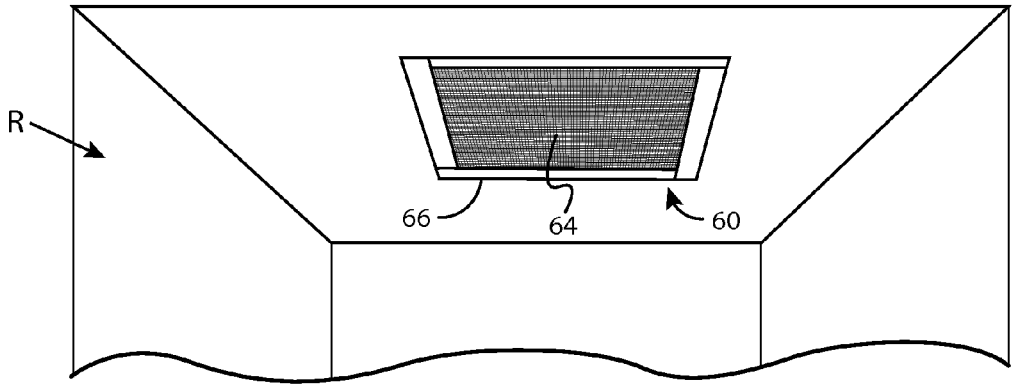

FIGS. 8A-8C are a series of perspective views showing installation of flat duct filter retainer 60 according to the concepts of the present invention over a supply vent V. included in FIGS. 8A-8C can be an example of a method of installing flat duct filter retainer 60 according to the invention about a vent V. In the example shown, the vent V can be located in the ceiling C of a ventilated space or room R. It will be appreciated that vent V may be located at other locations within the structure, and the flat duct filter retainer 60 may be applied in the manner described below without departing from the spirit or scope of the invention. As shown in FIG. 8A, flat duct filter retainer 60 can be positioned to encompass the vent V and in particular any openings O within vent V. Attachment assembly 62 can be used to attach flat duct filter retainer 60 to vent V or, as shown, the surrounding structure S. In the example shown, attachment assembly can include a frame 66 with single side(s) 70 with attachment(s) 72.

In embodiments, frame 66 and flat filter body 64 can be installed as separate sub-assemblies. Frame 66 and attachment(s) 72 can be applied prior to positioning the flat duct filter retainer 60 relative to vent V, or flat filter body 64 can be positioned about vent V and frame 66 can be applied to flat duct vent retainer 60 in place.

In embodiments, filters herein can also be installed over return vents (e.g., to prevent contaminants from entering a system from a room containing construction or fumes) without departing from the scope or spirit of the innovation. In particular embodiments involving return vents, an offset filter (described infra) can be attached to a return vent with the offset facing away from the return vent (e.g., creating an "open box" in front of the return vent) such that particles drawn to the return vent are not only blocked from passing through the vent but are trapped in the retainer.

Figure 9:
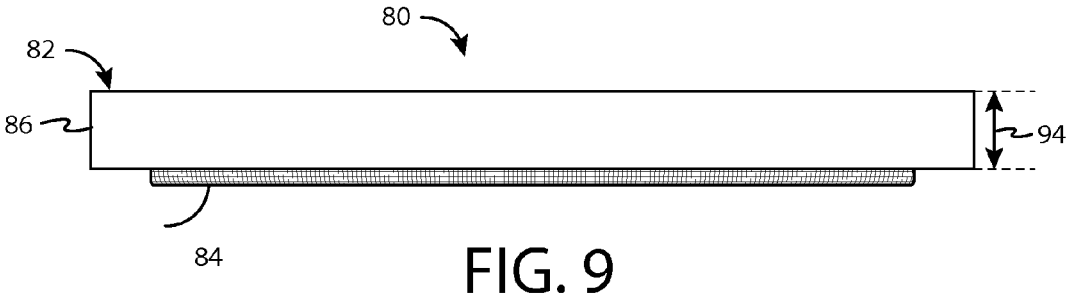
FIG. 9 is a side elevational view of an offset flat filter retainer according to the concepts of the present invention.
Figure 10:
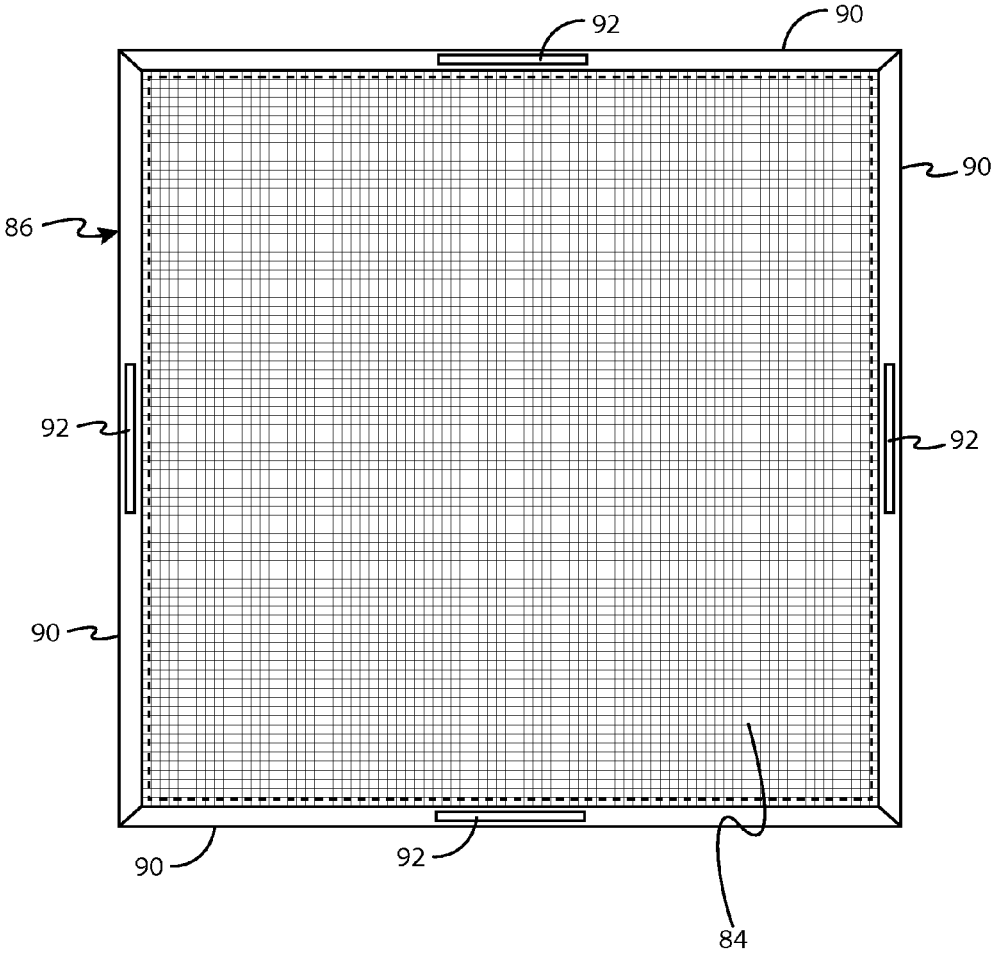
FIG. 10 is a top plan view thereof.

FIG. 9 is a side elevational view of offset flat filter retainer 80 according to the concepts of the present invention, and FIG. 10 is a top plan view of offset flat filter retainer 80. Offset flat filter retainer 80 can include offset assembly 82 and flat filter body 84. Flat filter body 84 can be a flat or substantially flat filter of a filter material herein. Offset assembly 82 can include frame 86, which can in turn include single side(s) 90 and attachment(s) 92. Offset assembly 82 can attach to a vent using at least attachment(s) 92, and secure flat filter body 84 between the vent and an environment beyond the vent (e.g., a room) at an offset distance of frame depth 94.

In embodiments, single side 90 can include one or more flanges (not pictured). For example, side 90 can include a top flange to provide a greater surface area for attachment(s) 92, while the wall portions (e.g., providing frame depth 94) can be thin to maximize a volume within offset flat filter retainer 80. In embodiments, flanges can also be used on a portion of single side 90 in contact with flat filter body 84 to facilitate attachment of flat filter body 84 to frame 86.

Figure 11:
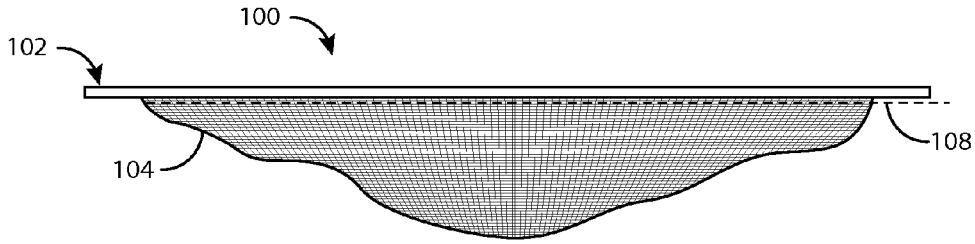
FIG. 11 is a side elevational view of a duct filter retainer including a stretchable filter body according to the concepts of the present invention.
Figure 12:
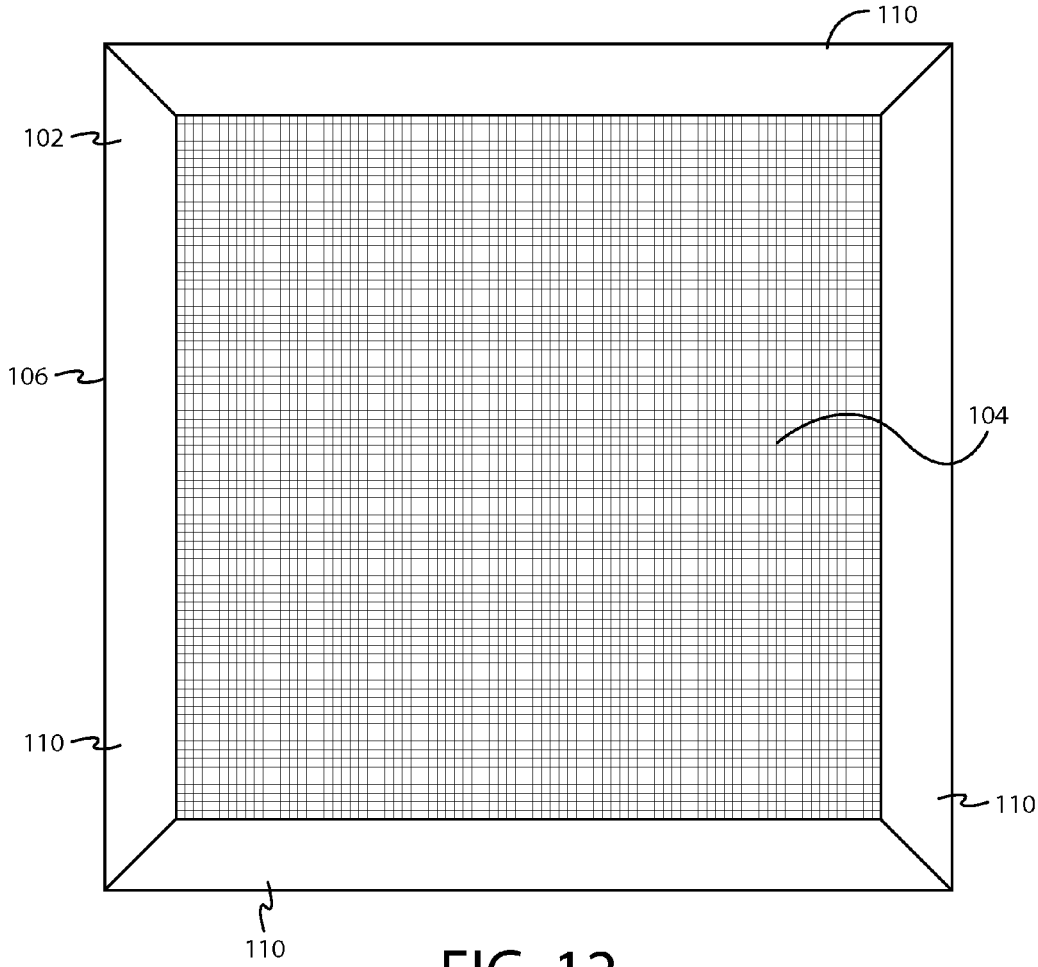
FIG. 12 is a top plan view thereof.

FIG. 11 is a side elevational view of duct filter retainer 100 including stretchable filter body 104 according to the concepts of the present invention, and FIG. 12 is a top plan view of duct filter retainer 100. Duct filter retainer 100 can include attachment assembly 102, frame 106, single side(s) 110, and stretchable filter body 104. Duct filter retainer 100 can initially include stretchable filter body 104 in a flat state. As duct filter retainer 100 collects particles, stretchable filter body 104 can stretch to collect additional particles.

Stretchable filter body 104 can include at least one stretchable filter material that can be (at least semi-) air permeable but restricts the passage of particles. In embodiments, stretchable filter body 104 can have an initial flat state (e.g., stretchable filter body aligns with flat line 108) and stretches (e.g., as shown in FIG. 11) upon retaining particles. Stretchable filter body 104 can have a structure facilitating symmetrical stretching (e.g., assumes a hemispherical shape when particles become trapped, not pictured), or asymmetrical stretching (e.g., as shown in FIG. 11). In embodiments, stretchable filter body 104 can be of a material that can return to its original shape on removal of the particles (e.g., at least partially elastic deformation). In embodiments, stretchable filter body 104 can be of a material that remains stretched after deforming (e.g., at least partially plastic deformation).

In embodiments herein, filters can include multilayer filter portions. For example, a filter or member assembly containing one or more filters can include a first filter body and a second filter body. In embodiments, one or both of the first filter body and the second filter body can be substantially flat or flush with an attachment assembly. In alternative embodiments, at least one of the first filter body and the second filter body can include a depth dimension (e.g., not flush with other filter body, one or more layers of filter material with substantial depth, and so forth).

In multilayer filters, the first filter body can include at least a first filter material, and the second filter body can include at least a second filter material. First filter material and second filter material can be intended to allow or limit the passage of different particles. For example, a filter material included in the first filter body can have a coarse (e.g., 25-micron) screen that blocks or traps particles larger than the permeable portions of the screen, and a filter material included in the second filter body can have a fine porous material (e.g., 0.3-micron pores) that blocks or traps particles small enough to pass through the coarse screen.

In various embodiments, third or additional filter bodies (not illustrated) can be included in duct filter retainer 120 (e.g., a multilayer filter portion or others) without departing from the spirit or scope of the invention.

In particular embodiments alternative or complementary to those described elsewhere herein, filters or assemblies employing filters can include a flexible attachment assembly.

A flexible attachment assembly can be, for example, various flexible or stretchable materials that can be formed or stretched around a vent or portion thereof. For example, a flexible attachment assembly can be a thin elastic portion that can be stretched larger a vent (e.g., around flanges of the vent, portion of the vent extending from wall or ceiling, and others) and retract around the vent after being placed over the vent. In embodiments using stretchable materials, a flexible attachment assembly can include an opening that is smaller than a vent to which a duct filter retainer employing the flexible attachment assembly is to be applied when in a non-stretched state.

In embodiments with or without stretchable materials, a flexible attachment assembly can be reshaped, opened, or closed (e.g., folded, cinched, and so forth) to attach to or under a vent. In embodiments, various drawstrings, zip ties, ratchet straps, hook and loop potions, and other sizing techniques can be employed to close a flexible attachment assembly to a particular size where the flexible attachment assembly is not stretchable. Sizing techniques can include continuous (e.g., drawstring) and discrete (e.g., snaps at regular intervals as with a semi-rigid one-size-fits-all strap assembly).

A flexible attachment assembly can include a widening portion. The widening portion can be a transitioning surface that facilitates a different size and/or shape for at least a portion of a duct filter retainer employing the flexible attachment assembly than the size and/or shape of the flexible attachment assembly and the vent to which it attaches. In embodiments, the widening portion can be (at least semi-) rigid and define a particular shape. In embodiments containing a frame with a duct filter retainer, the widening portion can be flexible and have its shape defined at least in part by the frame. While a narrow "neck" can be provide an interface between a flexible attachment assembly and a widening portion, it is to be appreciated that a flexible attachment assembly can be built into a widening portion, and/or an attachment assembly and a widening portion can be a single component. In embodiments, a duct filter retainer employing a flexible attachment assembly does not include a widening portion, and a filter body (and/or a frame) can be sized to accommodate the flexible attachment assembly.

In embodiments, a widening portion can be flat. In alternative embodiments, a widening portion can define a volume (e.g., above a filter body).

A widening portion can be made of a variety of materials. In embodiments, a widening portion can be formed of an impermeable material (e.g., rubber, polymer, metal, and others). In embodiments, a widening portion can be made of a filter material that is the same or different than a filter material used in a filter body.

In embodiments, a duct filter retainer can include a frame. However, alternative embodiments can include no frame, such that the vent to which duct filter retainer is attached and a flexible attachment assembly as attached can define at least a portion of the shape of the duct filter retainer. Put another way, a duct filter retainer need not include any rigid structural members or attachment means that otherwise define a shape of the duct filter retainer. In embodiments, a flexible attachment assembly can pull a filter body flat against a vent on installation without the use of other structural sub-assemblies.

In embodiments, non-flexible attachment assemblies can be employed. Various hardware mounting solutions (e.g., rigid portion in registry with vent, with or without gaskets or seals between rigid portion and vent) can be utilized. In embodiments, a magnet attachment can attach to at least a portion of the vent. In specific embodiments, the magnet can surround the vent and create a seal.

In various embodiments, duct filter retainers as described herein can be employed in sets. For example, a plurality of duct filter retainers can be applied to a plurality of vents within a structure or connected to a duct system (or subsystem) such that particles may not enter spaces beyond the vents of the ducts.

In a particular embodiment, a plurality of duct filter retainers can include two or more filter materials and be applied to a plurality of vents. Application to the plurality of vents can further be in a particular order. By using two or more filter materials on two or more vents, particular vents can be intended to capture specific particles. In this way, a fine-to-coarse, coarse-to-fine, or other by-vent media progression dependent on the filter material can be employed. For example, if a variety of contaminants are expected to be in a duct in sufficient quantity to fill or clog a single duct filter retainer, the a first duct can have a fine filter material applied such that the filter material outside the first vent traps pollen and fumes but allows paint chips and large dust balls to move to a coarser filter. Thus, duct filter retainers can fill or clog at a slower rate, and a greater number of particles can be prevented from passing through supply vents and/or being cycled through the entire duct system.

Embodiments herein can include disposable or washable portions. For example, a filter body can be removable, and after removal can be "emptied" (e.g., dumped out, shaken, vacuumed) or "washed" (e.g., with water, with soap and water, with other materials) for reuse. In other embodiments, a frame can be retained and a new filter body used with the frame. In still additional alternative or complementary embodiments, a filter body can be reused with a new frame (or portions thereof, e.g., new attachment).

Aspects herein can be used for the quarantine of vents or ducts by incorporating impermeable materials. For example, an impermeable plastic sheet can be used in accordance with frames, attachment apparatuses, and other aspects herein to prevent airflow through one or more portions of a ventilation system. Impermeable blocking materials can be used alone in embodiments. In alternative embodiments, impermeable blocking materials in combination with filters incorporating one or more filter media to accomplish an integrated plan for a particular ventilation layout. Examples of situations using impermeable materials can include mold remediation, asbestos and lead abatement, and others. In an embodiment, impermeable materials can be placed over return filters and one or more supply filters, and a filter material can be placed over the remaining supply filters to collect any debris or material previously accumulated in a ventilation system at designated vents.

While various retainers and components related thereto (e.g., filter bodies, frames, sides) are generally depicted in rectangular forms when viewed overhead, it is to be appreciated that a wide variety of geometries are possible. Various round or polygonal geometries can be employed without departing from the scope or spirit. For example, a duct retainer herein can conform to a circular vent shape. In other embodiments, various filter bodies or attachment apparatuses can be employed to perform similar functions on structures other than vents that are substantially flush with a flat surface. For example, a capped chimney or port can be surrounded or wrapped by an appropriately-sized attachment assembly or filter body such that the particle-trapping aspects described herein can be applied to other environments.

Various embodiments herein are not intended to be exclusive or exhaustive, and aspects herein can be combined or removed from various embodiments without departing from the scope or spirit of the invention. For example, an offset assembly as described herein can be used with a stretchable filter material as described herein, although such embodiments are not illustrated. In another example, a multi-layer filter can include a stretchable layer (e.g., bottom layer, layer that is offset from other layers, and so forth). It is to be appreciated that these and any other combination, while not illustrated or exhaustively described for purposes of brevity, are appropriately within this disclosure.

In accordance with the patent laws, the applicant's preferred embodiment and best mode have been described in the accompanying drawings and detailed description. The embodiments described and shown, however, should not be considered limiting as other embodiments will fall within the scope of the invention as defined by the appended claims.

What is claimed is:

1. A duct filter retainer used in connection with a wall or ceiling heating and air conditioning vent, the duct filter retainer comprising:

a filter body constructed of a filter material, the filter body is substantially flat when no debris is retained in the filter body, the filter body is disposed outside the wall or ceiling heating and air conditioning vent, the filter body is configured to deform in a direction outward from the wall or ceiling vent into a room in fluid communication with the vent to define a volume based on debris retained by the filter body; and an attachment assembly connected to the filter body configured to directly attach to a vent cover, a wall parallel to the vent cover, or a ceiling parallel to the vent cover over at least an exterior portion of the wall or ceiling heating and air conditioning vent and retain the filter body in an airtight fashion against the wall or ceiling heating and air conditioning vent, the attachment assembly is further configured to remain attached to the wall or ceiling by having an attachment strength greater than a sum of force from gravity on the duct filter retainer, force from gravity on debris retained in the filter body, and force from air conveyed through the wall or ceiling heating and air conditioning vent.

2. The duct filter retainer of claim 1, wherein the attachment assembly is at least partially flexible.

3. The duct filter retainer of claim 2, wherein the attachment assembly is stretchable.

4. The duct filter retainer of claim 3, wherein the attachment assembly attaches directly to the vent cover and includes an elastic band, wherein the elastic band defines an opening that is selectively expanded to receive a portion of the wall or ceiling vent and redacted to hold the filter body about the wall or ceiling vent.

5. The duct filter retainer of claim 1, wherein the attachment assembly is at least partially rigid.

6. The duct filter retainer of claim 5, wherein the attachment assembly includes at least one magnet.

7. The duct filter retainer of claim 1, wherein the attachment assembly includes at least one contact adhesive.

8. The duct filter retainer of claim 1, wherein the filter body defines an area larger than an area of the wall or ceiling heating and air conditioning vent.

9. The duct filter retainer of claim 1, further comprising a frame attached to a perimeter of the filter body, wherein the frame encompasses the perimeter and extends outward therefrom connecting with the attachment assembly.

10. The duct filter retainer of claim 9, wherein the frame includes a frame depth, and the filter body is offset from the wall or ceiling heating and air conditioning vent by a distance of at least the frame depth.

11. The duct filter retainer of claim 1, wherein the filter material includes a mesh.

12. The duct filter retainer of claim 1, wherein the filter material includes a porous material defining one or more pores through which air can escape.

13. The duct filter retainer of claim 1, wherein the filter material is elastic.

14. A method of providing a temporary filter for wall or ceiling HVAC vent, a method comprising:

providing a duct filter retainer having a deformable filter body constructed of a filter material;

providing an attachment assembly to a perimeter of the deformable filter body;

fastening the attachment assembly directly to a vent cover or wall or ceiling parallel to the vent cover to place the deformable filter body against the wall or ceiling HVAC vent in an airtight fashion and disposed outside the vent; and removing the duct filter retainer after particles have been collected within the deformable filter body.

15. The method of claim 14, further comprising providing an elastic member about the attachment assembly, and wherein fastening the attachment assembly includes expanding the elastic member to define an opening to receive at least a portion of the wall or ceiling HVAC vent cover and retracting the elastic member to hold at least the filter body about the wall or ceiling HVAC vent.

16. The method of claim 14, further comprising securing a flexible portion about the attachment assembly, the flexible portion defining an opening that is flexible to receive a portion of the wall or ceiling HVAC vent cover and hold at least the filter body about the wall or ceiling HVAC vent.

17. The method of claim 14, further comprising applying an adhesive to at least a portion of the attachment assembly, the adhesive holds at least the filter body about the wall or ceiling HVAC vent.

18. A duct filter retainer used in connection with a wall or ceiling vent, the duct filter retainer comprising:

a flexible filter body constructed of a flexible filter material;

an attachment assembly connected to the flexible filter body configured to directly attach over at least an exterior portion of the wall or ceiling vent and retain the filter body against the vent from outside the vent; and an airtight seal that prevents air or other matter from passing between the attachment assembly and the vent except through the flexible filter body.

19. The duct filter retainer of claim 18, wherein the flexible filter body is stretchable.

20. The method of claim 14, further comprising sealing the removed duct filter bag by folding the duct filter bag closed such that at least two portions of the attachment assembly mate to prevent spilling of the particles.

* * * * *